United States Patent [19]

Dillon

[11] Patent Number: 4,905,391

[45] Date of Patent: Mar. 6, 1990

[54] PORTABLE HIGHWAY SIGN STAND

[76] Inventor: George D. Dillon, N. 1300 Trails End, Rathdrum, Id. 83858

[21] Appl. No.: 274,849

[22] Filed: Nov. 22, 1988

[51] Int. Cl.[4] ..... G09F 15/00

[52] U.S. Cl. ..... 40/610; 248/168; 40/612; 40/606

[58] Field of Search ..... 40/610, 617, 584, 606, 40/607, 612; 248/168

[56] References Cited

U.S. PATENT DOCUMENTS

| | | | |
|---|---|---|---|
| 2,059,996 | 11/1936 | Goldberg | 40/606 X |
| 2,995,847 | 8/1961 | Carpenter | 40/610 |
| 3,153,872 | 10/1964 | Walter | 40/610 |
| 3,207,206 | 9/1965 | Braddon et al. | 248/168 |
| 3,490,749 | 1/1970 | Anderson | 40/610 X |
| 3,608,220 | 9/1971 | Frybar | 40/606 |
| 3,677,511 | 7/1972 | Dickie | 40/610 |
| 3,847,335 | 11/1974 | Ross | 40/610 |
| 3,867,775 | 2/1975 | Lapham et al. | 40/606 |
| 3,899,843 | 8/1975 | Doyle et al. | 40/610 X |
| 4,019,271 | 4/1977 | Latimer | 248/168 X |
| 4,203,242 | 5/1980 | Griffin | 40/610 |
| 4,309,836 | 1/1982 | Knapp | 40/610 X |
| 4,326,687 | 4/1982 | Clyburn | 248/168 |
| 4,676,015 | 6/1987 | Stoudt | 40/606 |
| 4,695,021 | 9/1987 | Leinfelder | 248/168 |

FOREIGN PATENT DOCUMENTS

| | | | |
|---|---|---|---|
| 95205 | 1/1963 | Denmark | 40/610 |

*Primary Examiner*—Kenneth J. Dorner
*Assistant Examiner*—Wenceslao J. Contreras
*Attorney, Agent, or Firm*—Keith S. Bergman

[57] ABSTRACT

A tripod-type support is disclosed to releasably support a resiliently deformable highway sign in a stressed condition. Two front tripod legs carry medial brackets to support lower peripheral portions of a sign and the rearward leg in its upper part pivotally supports an upper arm that adjustably fastens the uppermost portion of a sign and moves to a position to stress and positionally maintain a supported sign. The support is adapted to positionally maintain both standard three and four foot square highway signs. Auxiliary apparatus releasably positions flags at an eight foot elevation above ground level.

7 Claims, 2 Drawing Sheets

PORTABLE HIGHWAY SIGN STAND

BACKGROUND OF THE INVENTION

Related Applications

There are no applications related hereto heretofore filed in this or any foreign country.

FIELD OF INVENTION

My invention relates generally to portable tripod stands for supporting highway signs and more particularly to such a stand that releasably fastens a sign in stressed condition.

BACKGROUND AND DESCRIPTION OF PRIOR ART

Many and various signs are used in connection with roadways to convey information to users of those roadways. These signs generally may be classified, on the basis of the nature of their support, into a first class including more or less permanently installed signs that are generally fixedly positioned in the earth or on permanent structures and a second class of temporary supports that are of a portable, generally collapsible nature, not physically connected in the earth or on permanent structures, and generally for use during relatively short periods of time. The second class of signs is commonly used during highway construction and maintenance operations, during periods of temporarily changed highway conditions, and for other similar purposes. The instant invention provides a new, novel and improved member of this second class of sign support.

Highway signs, to accomplish their purposes, must effectively convey information to a highway user. This requires that the information to be conveyed must be presented in some form that is cognizable by a user under prevailing conditions and in general, this requires symbology or lettering to be of relatively large size so the signs may be readable by a highway user in a vehicle traveling at a substantial rate of speed relative to a sign. Such relatively large symbology in turn necessarily requires a sign of fairly substantial size to carry it.

Problems associated with the lack of cognizability of information presented by highway signs oftentimes have serious consequences and have heretofore resulted in vehicular accidents that have caused substantial economic losses. Often these losses have ultimately fallen on sovereign governments and their agencies by reason of legislation or judicial determination and responsively, the nature of such signs, including their size, construction and positioning, has been fairly well regulated not only by reason, but also by positive laws and rules of fairly detailed nature. In general these regulations have fairly well standardized sign configuration to a square configuration with a side dimension of three or four feet and a sign orientation with a diagonal being vertically orientated. The material from which the signs are formed has not been so specifically regulated, but its use dictates that the material be of a flat sheet-like nature with relative strength and durability and preferably of no more mass than necessary. In the present day highway sign art the two materials that have commonly evolved for signboards are pressboard sheets of various types embodying binders and fibrous materials or sheet metal, and especially sheet aluminum, of appropriate thickness.

Such signboards present some substantial problems in their positional maintenance and those problems have not been particularly well addressed, if addressed at all, by the prior art.

Such signs generally must be positionally maintained at a distance above the earth of approximately four feet in relatively open areas that are subject to all of the forces of nature and especially strong winds. Even a moderate wind, when acting upon the substantial area necessarily defined by a sign surface, creates a substantial force and this force has been perennially a problem both in dislodging a sign from its support and in moving a support from its desired supportive position. Commonly in the past, signs have been maintained on supports by some passive type of fastener with which the sign itself does not actively participate, such as by wiring or fastening with screws, nut-bolt combinations, rivets, or the like. This passive type of sign fastening has been notoriously ineffective not only in being difficult and time consuming to establish in the first instance, but also in lacking durability and being subject to a multitude of destructive forces and conditions.

My invention in contradistinction uses the signboard itself as an active element in fastening a sign to a support by providing a mechanism which stresses the sign by flexation to cause deformative forces in the sign during its fastened support upon the stand. Such forces tend to maintain the sign in a well fastened condition at all times and in conjunction with the pivotal upper support arm of my support have the additional benefit of providing fastening structure that is embodied in the stand itself without requirement of secondary separable fastening elements such as wire, bolts, screws or the like. This method of sign fastening also provides more strength and durability for both sign and stand, as it does not depend upon either the definition or maintenance of a hole structure in the signboard, as do other fastening methods dependent upon secondary mechanical fasteners. Most of the present day resiliently flexible signboard materials may be used with my type of sign fastening, though undoubtedly an aluminum sign is somewhat better adapted to this use and tends to provide more durability, but any such resiliently deformable signboards have more durability when fastened with my invention than when fastened with secondary mechanical fasteners of the prior art.

Temporary sign supports to be effective must be of a relatively portable nature, which generally requires some form of collapsibility, and they must also provide structure that allows support under a multitude of varying topographical conditions. To fulfill this requirement, it has become common in the prior art to use some sort of a tripod-like structure for ultimate support on the earth or similar supportive surface. This three-point support allows use on rough and uneven or undulating surfaces since the three ends of a tripod support define a plane, whereas either a greater or lesser number of legs would not do so and would tend to limit the nature of the surface upon which the support device could be supported. My invention allows the use of this tripod type of support in the traditional fashion, and provides additional benefits of continuously maintaining the tripod support itself in a stressed condition while it is supporting a sign.

The stressed tripod condition tends to further the positional maintenance of the support in its erected supporting mode. Prior art devices have not provided such tensioning and have been notorious for their accidental collapse responsive to external forces of various sorts that oftentimes are placed upon them. My tripod support also still permits the use of other types of support means heretofore commonly used with support devices, including the traditional weighted bag structures supported either by the tripod support structure or on the earth thereabout, with or without direct fastening to the tripod support.

It is often desired, and sometimes required by various regulations, that colored flags carried on vertical standards be displayed with certain highway signs to particularly call attention to the signs. Generally such flags must be positioned above an associated sign to be effective and some regulations require that these flags be at an average height as high as eight feet above a surface supporting a sign. Most sign supports of the prior art have either not provided means for supporting flags with the signs they support or else have not supported those flags at an eight foot height. My invention provides auxiliary flag support structure associated with the upper portion of the upper sign fastening arm that releasably carries a plurality of flags at the required height above a support surface.

My invention resides not in any of these features per se, but rather in the synergistic combination of all of its structures to accomplish the functions necessarily flowing therefrom, as hereinafter further specified and claimed.

SUMMARY OF INVENTION

My invention generally provides a tripod support structure having cooperating sign support brackets on two forward legs and pivotally carrying an upper support arm on the third rearward leg to support the upper portion of a sign so that the sign is maintained in a stressed condition. The upper support arm tends to maintain its upward supporting position once it is so positioned with a sign supported thereby. The upper support arm carries a plurality of spaced support notches for sign support to accommodate the wearing of signs and to allow mounting of different sized signs. The support structure provides means for associating traditional weight bags to aid positional maintenance.

An auxiliary flag support structure is releasably positionable on the upper end portion of the upper support arm to releasably carry plural flags at an eight foot height above a supporting surface.

In creating such a device, it is:

A principal object of my invention to provide a portable tripod-type support for highway signs, especially of a temporary nature, that supports a resiliently deformable sign in a stressed condition to aid positional maintenance of the sign and also maintenance of the supportative mode of the support structure.

A further object of my invention to provide such a support that has a pivotally mounted upper support arm which is biased to a supporting position when once so placed.

A still further object of my invention to provide such a support that is adapted to support various sizes and shapes of highway signs in common present day use.

A still further object of my invention to provide such a support that has a releasably positionable flag support carried by the upper portion of the upper arm to releasably carry flags at a height eight feet above a surface supporting the support structure.

A still further object of my invention to provide such a support that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

My invention generally comprises upright tripod support 10 pivotally supporting upper fastening arm 11 to fasten sign 12 on the tripod with some tension.

Figure 2:
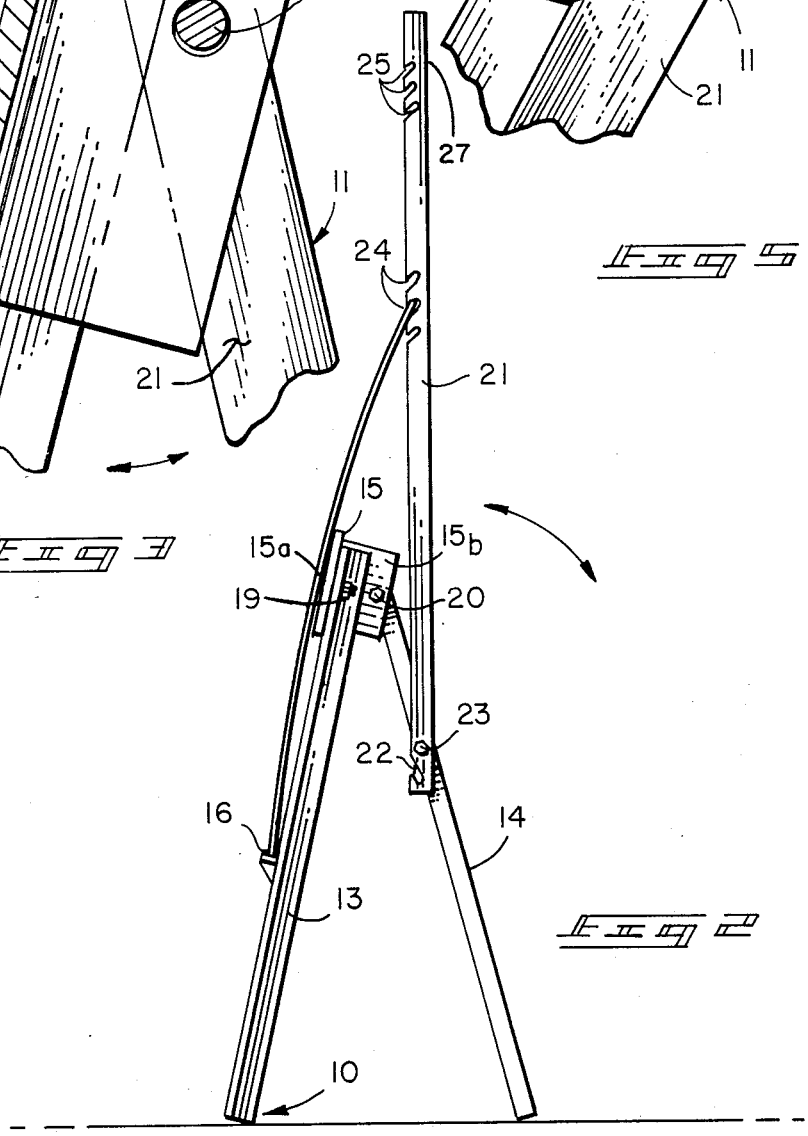
FIG. 2 is an orthographic side view of my support device with a resiliently deformable sign in fastened position therein.

Tripod support 10 provides two similar front legs 13 and rearward leg 14 all pivotally joined in their uppermost portions by interconnection to common fastening plate 15. The two forward legs 13 comprise elongate elements of "L" shaped cross-section commonly known as angle iron, and rearward leg 14, in the instance illustrated, comprises a box channel element having a cross-sectional shape of a peripherally defined rectangle. The length of these elements is such that when they are angularly disposed in a supportive position, as illustrated in FIG. 2, they will support a sign carried thereon at a medial height of about four feet, which is the generally desired height for common roadway signs. The dimensions may be varied within limits to support signs at different heights.

The forwardly facing surfaces of laterally extending forward legs 13 each carry sign support brackets 16 structurally joined to the legs, in the instance illustrated by welding 17. The brackets preferably are joined with their containing legs facing upwardly and with their supportive surfaces 18 angled approximately forty-five degrees inwardly and downwardly so that surfaces 18 will be substantially parallel to the edges of a square sign to be supported thereby. The height of support brackets 16 upon the forward legs determines the height at which a sign will be supported and normally is such as to position the medial portion of a sign approximately four feet from a surface supporting the support. This dimension may vary in particular instances so long as it is related to the mechanical parameters of upper fastening arm 11.

Figure 3:
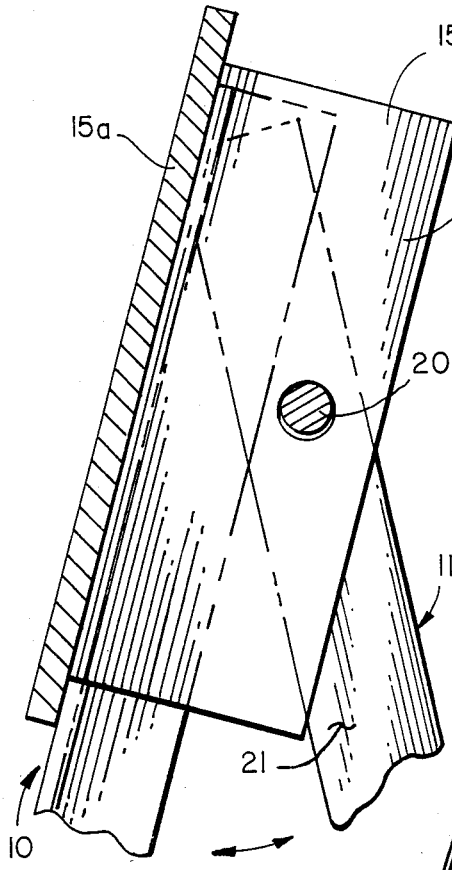
FIG. 3 is an enlarged partial orthographic side view of the interconnecting structure of the top portion of the tripod legs.
Figure 5:
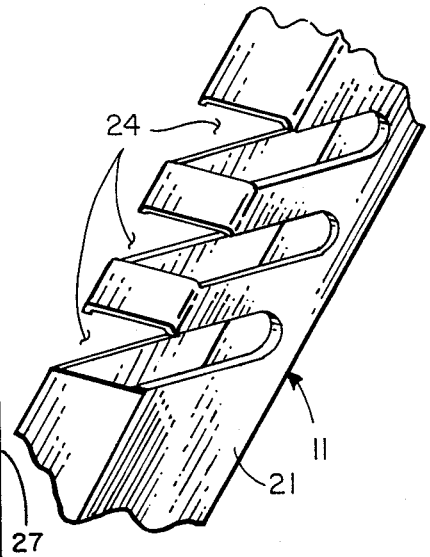
FIG. 5 is an enlarged partial isometric view of a series of spaced fastening grooves defined in the upper fastening arm.

Common fastening plate 15, as shown in FIG. 3, is a "T" shaped element with forwardly facing arm 15*a* intercommunicating with rearwardly extending perpendicular base 15*b*. The two forward support legs 13 are pivotally mounted on each lateral portion of forward arm 15*a* by mechanical interconnection, in the instance illustrated by nut-bolt combinations 19 extending therebetween. Rearward leg 14 is pivotally fastened by nut-bolt combination 20 extending through appropriate holes in the medial portion of rearward arm 15*b* and through the upper portion of rearward leg 14. This structure allows limited pivotal motion of the two forward legs toward and away from each other in the plane of forward arm 15*a* of the fastening plate and limited pivotal motion of rearward leg 14 in a forward-rearward direction in the plane of rearward arm 15*b* to allow folding of all legs relative to each other in a collapsed mode of the support for storage and transport. The support legs are designed to pivot away from each other a distance of approximately four feet in their lowermost portions and the joining and fastening structures of these elements are so positioned and configured as to allow and limit this motion of the legs.

Upper fastening arm 11 provides elongate box channel element 21 having angled slot 22 defined inwardly adjacent a first end part, which is the lower end shown in FIG. 2 of the illustrations, to form a hook-like structure at the first end to receive and releasably carry a weighting device. Channel element 21 is pivotally mounted, inwardly adjacent slot 22, on the upper medial portion of rearward leg 14 by mechanical fastening device 23 extending therebeween. This fastening device 23 in the instance illustrated is a nut-bolt combination. The medial portion of channel element 21 defines a group of spaced angulated slots 24 extending inwardly from the forward facing surface of the channel body to receive the upper portion of a smaller sign and the outer portion of that element defines a second group of similar spaced angulated slots 25 to receive the upper portion of a larger sign. These slots 24, 25 extend in an upwardly angled direction opposite to the direction of slot 22. The spaced series of such slots is provided to accommodate signs of varying dimension and to allow adjustment of tension in a particular sign.

The relative positioning of the upper fastening arm on rearward leg 14 must be regulated in relationship to the positioning of the sets of slots 24, 25 and the positioning of support brackets 16, as illustrated particularly in FIG. 2. When sign 12 is supported in brackets 16 with a diameter substantially vertical, its upper apex must fit within one of the groups of slots 24, 25 with some tension in the sign, so that the sign bows slightly when in fastened position as illustrated. The plural spaced slots 24, 25 of each slot group allow adjustment of this positioning and tensioning as required especially by sign irregularity and wear. Commonly, most signs to be supported will be of relatively few nominal sizes, but they ordinarily may have some dimensional variance between individual signs.

A flag support provides body portion 26 to releasably fit in adjacency on end part 27 of channel element 21. The body in its upper part carries plural angularly arrayed flag support arms 28 defining channels to slidably receive standards 29 of ordinary warning flags 31, as presently used in conjunction with highway signs. Flag support body 26 carries angled brackets 30 that extend into slots 32 defined in the upper arm channel to releasably fasten the flag support on end portion 27 of the channel element 21. This flag support is not a necessary part of my invention, may take different forms, and in general is known per se in the prior art, but my invention does position this element by reason of its particular structure at heights at which flags commonly are required to be displayed.

Preferably the support structure described is formed of metallic elements of the configurations specified. Other rigid materials such as harder, more dense polymeric or resinous plastics might be used for its formation, but in general they provide little advantage if any and do not give the strength and durability that is given by metallic elements. The metal of preference for formation of my support is mild steel of the various commercial shapes indicated. With use of this material, elements that are fixedly joined are joined by welding and elements that are movably joined are preferably joined by nut-bolt combinations or riveting.

Having thusly described the structure of my invention, its use may be understood.

Firstly, a support structure is formed according to the foregoing specification. The support legs may be moved together into proximity and the upper fastening arm lowered so that its second end portion extends substantially parallel to the lower portion of rearward leg 14. In this collapsed condition, the structure occupies its least volume and is conveniently arrayed in a consolidated mode for carriage or storage. For use, the legs are spread apart, away from each other, so that they form an angle of approximately sixty degrees from each other with a distance of about four feet between the lower ends of each leg. The support is then positioned on the earth or some other supportive surface where required for use and is then ready for placement of a sign to be supported.

Signs to be carried by my support are formed of somewhat resiliently deformable sheet material of reasonable strength and durability, commonly sheet metal, wood, or a harder pressed particle board of some type. Such signs normally have a thickness of one-quarter inch or less and have become reasonably standardized in square peripheral shapes having a side dimension of three or four feet. The various dimensional parameters of my support must be determined relative to each other, as specified, to allow support of such signs with some resilient deformation when in supported position. The required dimensional parameters may be readily determined either by known engineering methods or empirically for particular signs and particular materials. The type of signs common in present day use bear alpha-numeric characters that appear in an upright cognizable position when one diagonal of the sign is vertically oriented.

Figure 4:
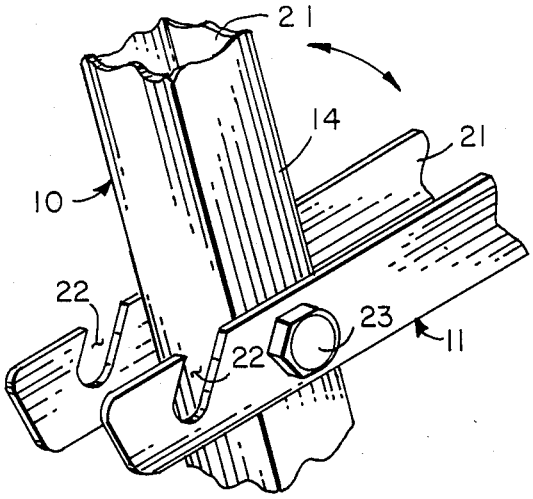
FIG. 4 is an enlarged partial isometric view of the pivotal interconnection of the upper fastening arm with the rear support leg.
Figure 6:
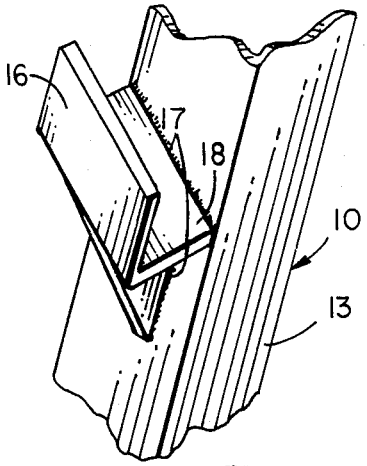
FIG. 6 is an enlarged partial isometric view of a fastening bracket carried on one of the forward legs of my support.
Figure 1:
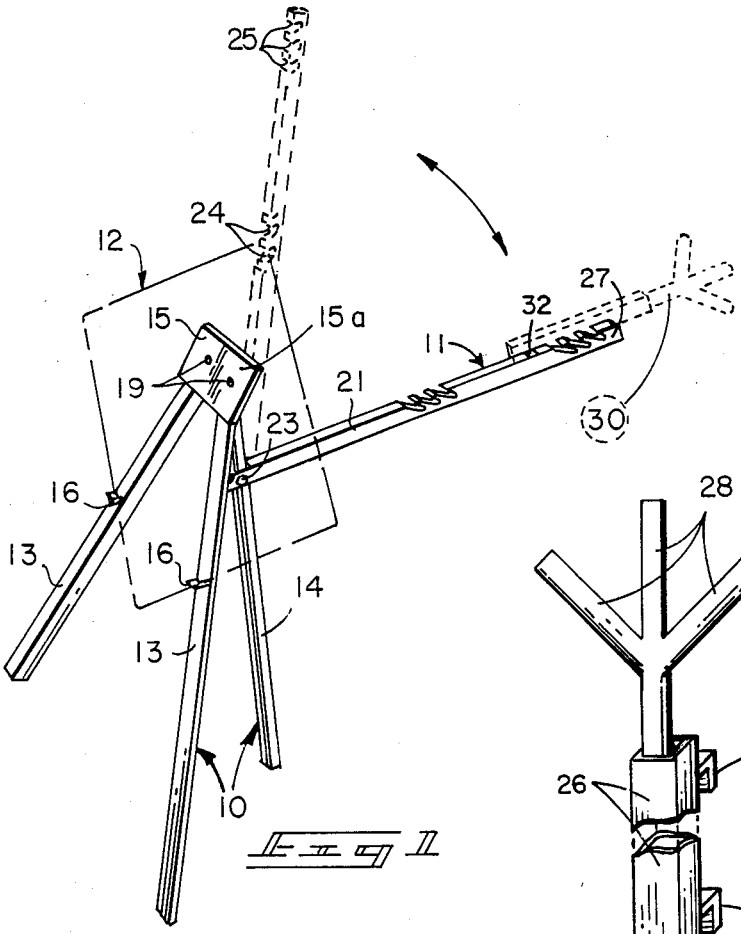
FIG. 1 is an isometric view of my support showing its parts, their configuration and relationship, with a sign, flag support and the upper fastening position of the fastening arm illustrated in dashed outline.
Figure 7:
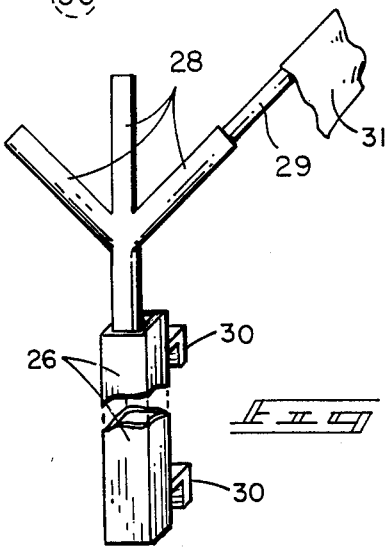
FIG. 7 is a partially cut-away isometric view of an auxiliary flag holding device.

To positionally maintain such a sign on my support structure, the sign is positioned with the appropriate diagonal vertical by manual manipulation so that its two adjacent lower edges are substantially symmetrically supported in support brackets 16, as illustrated in FIG. 1. Upper fastening arm 11 is then moved upwardly toward a position approaching vertical and the upper apex of sign 12 is flexed and inserted in an appropriate slot 24, 25 wherein the sign apex best fits immediately adjacent the inner portion of the slot. The upper fastening arm then is biased forwardly by sign tension, but the arm will not move in a forward direction because to do so would create more tension in the sign than is already existent, since the arm's forward pivotal motion would have a downward component. The fastening arm cannot move rearwardly because the rearward surface of a supported sign is adjacent the forward portion of fastening plate 15.

It is to be noted that in accomplishing this positioning that the over-center position of upper fastening arm 11 will tend to be positionally maintain with some bias, because the stressed deformation of sign 12 will create a component of force tending to move the upper arm in a forward direction but yet prevent this motion because of the configuration and rigidity of the sign itself. This force may be overcome by appropriate manual manipulation of the arm in a rearward direction when desired for sign removal. The stress created in sign 12 by reason of bowing action when in fastened position creates tension in the entire support structure that not only tends to positionally maintain a sign, but also tends to maintain the erected supporting mode of the support, as all of the interconnected members will tend to be positionally stabilized relative to each other by this stress.

The stability of the support may be further enhanced by use of traditional weights such as bags commonly formed of flexible fabric and filled with heavy material such as gravel, rock or sand. Such weights may be placed about the lower portions of legs 13, 14 to aid in their positional maintenance on a supporting surface and may be suspended by their fabric, wires, or other fastening element carried by the support, especially as from slot 22. A weight supported in slot 22 will also tend to aid the positional maintenance of a supported sign, as that slot must move in an upward direction against the bias of a weight if fastening arm 12 be moved to tend to release the sign from the support structure.

The operation of my support device is the same for signs positioned in either inner slots 24 or outer slots 25.

It should also be noted that a rectilinear sign may be positioned, with diagonal orientation or its sides oriented in vertical and horizontal orientation, in the same fashion described for a diagonally oriented square sign. The action of my support is substantially similar, but by reason of a sign's rectilinear configuration it may be somewhat more difficult to flex and in general, a rectilinear sign horizontally oriented may not be flexed to the same degree as a square sign oriented with a diagonal vertical. My support structure might also support round or polygonal signs in similar fashion to that described.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A tripod structure to releasably support a relatively thin, flexibly resilient sign in a flexed condition, comprising, in combination:

a tripod structure having two forward angularly related legs, each carrying a sign support bracket on its medial forward portion, pivotally interconnected in their upper end portions to a fastening plate pivotally carrying a rearward leg extending angularly rearwardly away from the forward legs;

an elongate upper fastening arm pivotally mounted, inwardly adjacent a first lower end, in a medial position on the rearward leg for upward pivotal motion, said upper fastening arm defining at least one slot to receive the upper portion of a sign supported in the support brackets on the forward legs.

2. A tripod structure to releasably support a relatively thin, flexibly resilient sheet-like sign in a flexed condition, comprising, in combination:

a tripod structure having two forward legs, each carrying a sign support bracket in its forward medial portion, pivotally interconnected in their upper end portions to a common fastening plate for limited pivotal motion in a plane defined by the forward legs and a rearward leg carried by the common fastening plate for limited rearward pivotal motion toward and away from the forward legs;

an upper fastening arm pivotally mounted, inwardly adjacent a first lower end, in a medial position on the rearward leg for upward pivotal motion of a second upper end toward the forward legs about to a vertical line through its pivot point, said upper fastening arm having at least one set of plural spaced slots defined in its forward facing surface to receive the upper portion of a sign supported in the support brackets carried by the forward legs and create tension in the sign when so supported.

3. The invention of claim 2 further characterized by the fastening brackets angling inwardly and downwardly at an angle of substantially forty-five degrees to the legs carrying them.

4. The invention of claim 2 further characterized by the first end of the upper fastening arm below its pivot having means for releasably attaching a weight to aid positional maintenance of the support.

5. The invention of claim 2 further characterized by a releasably fastenable support for standards of a plurality of flags carried on the second end portion of the upper fastening arm to releasably support flags therein.

6. A tripod structure to releasably support under tension a square resiliently deformable highway sign, orientated with a diagonal vertical, comprising in combination:

a tripod having two elongate forward legs, with sign fastening brackets in their medial portions, pivotally interconnected in their upper end portions to the arm of a "T" shaped fastening plate for limited pivotal motion toward and away from each other, the body of the fastening plate extending rearwardly and pivotally interconnecting the upper portion of a rearward leg for limited pivotal motion toward and away from a plane through the forward legs;

an upper fastening arm pivotally carried, inwardly adjacent its first lower end, in a medial position on the rearward tripod leg for upward pivotal motion of its second upper end substantially to a vertical line through the pivotal interconnection with the rearward leg, said upper fastening arm defining in its forward portion at least one set of plural spaced slots, one of said slots fitting substantially adjacent the upper portion of a sign supported in its lower portion on the brackets carried by the forward legs, and a resiliently deformable sign carried under tension between said cooperating support brackets on the forward legs and said supporting notch defined in the upper fastening arm.

7. The invention of claim 6 further characterized by a plurality of spaced groups of slots defined in the upper fastening arm to fasten signs of a plurality of configurations and sizes on said support.

* * * * *